US006662420B1

(12) United States Patent
Rosier

(10) Patent No.: US 6,662,420 B1
(45) Date of Patent: Dec. 16, 2003

(54) HYDRAULIC INSTALLATION TOOL

(75) Inventor: Hendrik E. Rosier, Port Ewen, NY (US)

(73) Assignee: Huck International, Inc., Tucson, AZ (US)

( * ) Notice: Subject to any disclaimer, the term of this patent is extended or adjusted under 35 U.S.C. 154(b) by 0 days.

(21) Appl. No.: 10/234,219

(22) Filed: Sep. 4, 2002

(51) Int. Cl.[7] ..... B21J 15/10; B21J 15/20

(52) U.S. Cl. ..... 29/243.529; 29/243.522; 72/391.8

(58) Field of Search ..... 72/391.2, 453.17, 72/391.4, 391.8; 29/243.529, 243.522, 243.521

(56) References Cited

U.S. PATENT DOCUMENTS

| | | | | | |
|---|---|---|---|---|---|
| 3,475,945 | A | * | 11/1969 | Chirco | 72/391.2 |
| 3,593,401 | A | | 7/1971 | Chirco | 29/200 |
| 3,713,321 | A | * | 1/1973 | LaPointe | 72/391.2 |
| 4,615,206 | A | * | 10/1986 | Rosier | 72/453.17 |
| 4,796,455 | A | | 1/1989 | Rosier | 72/391 |
| 4,896,522 | A | * | 1/1990 | Rosier | 72/453.17 |
| 5,208,959 | A | * | 5/1993 | Rosier et al. | 72/391.2 |
| 5,228,610 | A | | 7/1993 | Spence | 224/267 |
| 5,297,325 | A | | 3/1994 | Thelen | 29/237 |
| 5,305,510 | A | | 4/1994 | Croft et al. | 29/237 |
| 5,371,933 | A | * | 12/1994 | Godfrey | 29/243.529 |
| 5,483,731 | A | | 1/1996 | Prendel et al. | 29/237 |
| 5,592,726 | A | | 1/1997 | Suresh | 29/237 |

OTHER PUBLICATIONS

352 Tool, Instruction Manual and Blueprint.
206–375 Tool and 99–1700 Series Noses, Blueprints.
700 Series tool, Blueprint.

* cited by examiner

*Primary Examiner*—David Jones
(74) *Attorney, Agent, or Firm*—David P. Maivald

(57) ABSTRACT

A hydraulic installation tool for installing fasteners is provided, that includes a housing having a first portion adapted to receive a drawbar and a second portion adapted to receive a piston, a gland and a retaining ring. A generally L-shaped drawbar is disposed in the first portion of the housing and a piston, a gland and a retaining ring is disposed in the second portion of the housing. The hydraulic installation tool is useful in securing lockbolt or swage type fasteners.

20 Claims, 5 Drawing Sheets

HYDRAULIC INSTALLATION TOOL

FIELD OF THE INVENTION

The present invention relates to installation tools for setting pull type fasteners.

BACKGROUND OF THE INVENTION

Installation tools and related nose assemblies are utilized in conjunction with a hydraulic pressure source for installing multi-pieced fasteners by applying a relative axial pulling force, for example, between a pin or mandrel and a collar or sleeve. A lockbolt or swage type fastener is an example of a multi-piece fastener that has a pin and collar adapted to be set with the relative axial pulling force of an installation tool. A blind type fastener is another example of a multi-piece fastener that has a pin and a sleeve adapted to be set with the relative axial pulling force of an installation tool. With both the lockbolt and blind type fasteners, the pin has an elongated shank provided with a pintail or pull portion having a plurality of pull grooves adapted to be gripped by a plurality of chuck jaws in the nose assembly. In the deactuated condition, the chuck jaws will be normally held open to facilitate insertion of the pintail portion into the aperture defined by the opened chuck jaws as well as ejection after the fastener has been set. During actuation of the tool with the pintail portion located in the nose assembly, the chuck jaws will be moved to a closed condition for engagement with the pull grooves whereby the pull grooves will be gripped by the chuck jaws.

A swage anvil member is adapted to engage the collar or sleeve, depending upon the type of fastener, and, upon actuation of the tool and with the chuck jaws gripping the pintail portion of the pin shank, as noted, a relative axial pulling force is then applied between the collar or sleeve and pin of the fastener by way of the relative axial force between the chuck jaws and the anvil. Typically, the pin or mandrel is provided with a weakened portion or breakneck groove which is located on the pin shank between the pull or pintail portion and the remainder of the shank and is adapted to fracture at a preselected axial load, i.e. pin break load, after the fastener has been set. This results in an installed fastener having a generally flush structure with minimal or no pintail protrusion. In certain tools, the severed pintail portion is ejected rearwardly out through the back end of the tool.

The magnitude of the pin break load required to fracture the breakneck groove, however, can result in the generation of a reaction load of significant magnitude. The magnitude of pin break load can be especially high with swage type fasteners since the breakneck groove must be of sufficient strength to withstand the high installation loads required for the anvil to swage the collar onto the pin. As a result, in hand held installation tools employing a construction for pass through or rearward ejection, the severed pintail portion could be ejected with a considerable force in the direction of the operator. As a result, it has been a common practice with such tools to utilize a pintail deflector made of an elastomeric material to absorb some of the force of the pintail portion and to deflect the pintail portion away from the operator.

In certain aerospace applications, a limited amount of space is provided for fastening workpieces together with a fastener. In such applications or other applications with a limited amount of space, it is necessary for an operator to have a compact installation tool with a minimal center line to edge distance in order for the operator to be able to fasten the workpieces together in these hard to reach locations. Center line to edge distance refers to the distance from the center of the bore of the installation tool that has a nose assembly disposed therein to the top edge of the installation tool. A need exists in the art these types of compact installation tools.

Additionally, in areas of limited clearance space, installation tools are typically operated at high pressure. Unfortunately, at high pressure, hydraulic hoses attached to the installation tool become rigid and limit the range of movement that an operator has with the installation tool. At lower pressures, hydraulic hoses are more flexible and extends the range of movement that an operator has with the installation tool. A need exists in the art for compact installation tools that operate at lower pressure to facilitate a greater range of movement with the installation tool.

SUMMARY OF THE INVENTION

It is an object of the invention to provide an installation tool that can be used in applications that provide a limited amount of space to an operator of the tool.

It is an additional object of the invention to provide an installation tool that is compact and has a minimal center line to edge distance.

It is another object of the invention to provide an installation tool that operates at lower pressures with flexible hydraulic hoses.

These and other objects of the invention are achieved by providing a hydraulic installation tool for installing fasteners, that includes a housing having a first portion adapted to receive a drawbar and a second portion adapted to receive a piston, a gland and a retaining ring. The drawbar has a general L-shape, a through bore and a bore. A portion of the drawbar is slidably disposed within the first portion of the housing. The piston has a threaded bore and a portion of the piston is slidably disposed within the second portion of the housing. The gland has a first bore adapted to receive a portion of the piston and the gland is disposed within the second portion of the housing with a portion of the piston passing through the bore of the gland. The gland also has a threaded second bore that is adapted to receive a threaded screw. The retaining ring has a bore and the retaining ring is disposed within the second portion of the housing and threadedly engages the housing with a portion of the piston passing through the bore of the retaining ring. A threaded first screw passes through the bore of the drawbar and threadedly engages the threaded bore of the piston and a threaded second screw passes through the bore of the retaining ring and threadedly engages the threaded second bore of the gland.

DETAILED DESCRIPTION OF PREFERRED EMBODIMENTS

Figure 1:
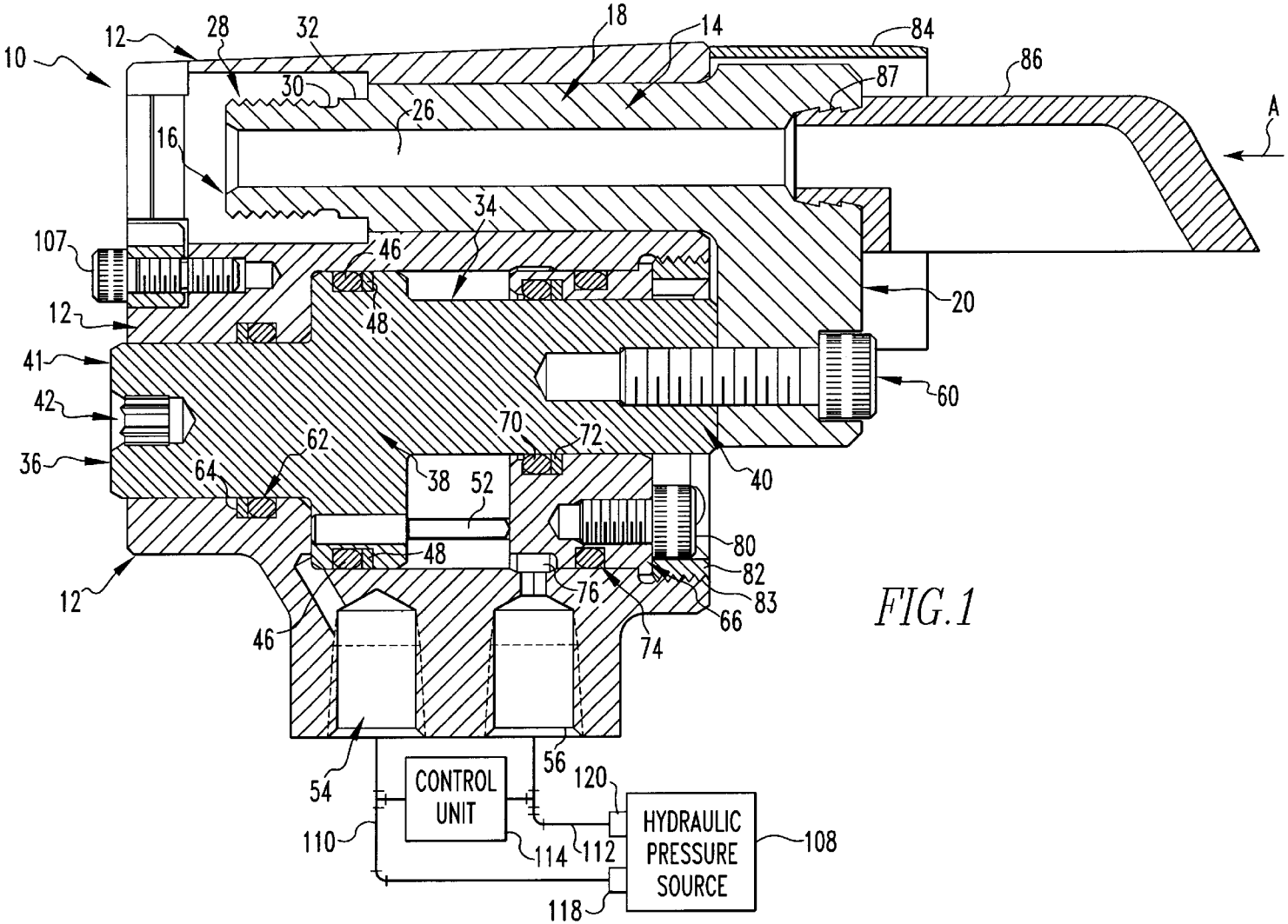
FIG. 1 is a side sectional view, to enlarged scale, of the installation tool with the installation tool shown in the deactuated condition and with a pintail deflector attached to the installation tool. A control unit and hydraulic pressure source which are operable with the installation tool are generally shown in block form.
Figure 2:
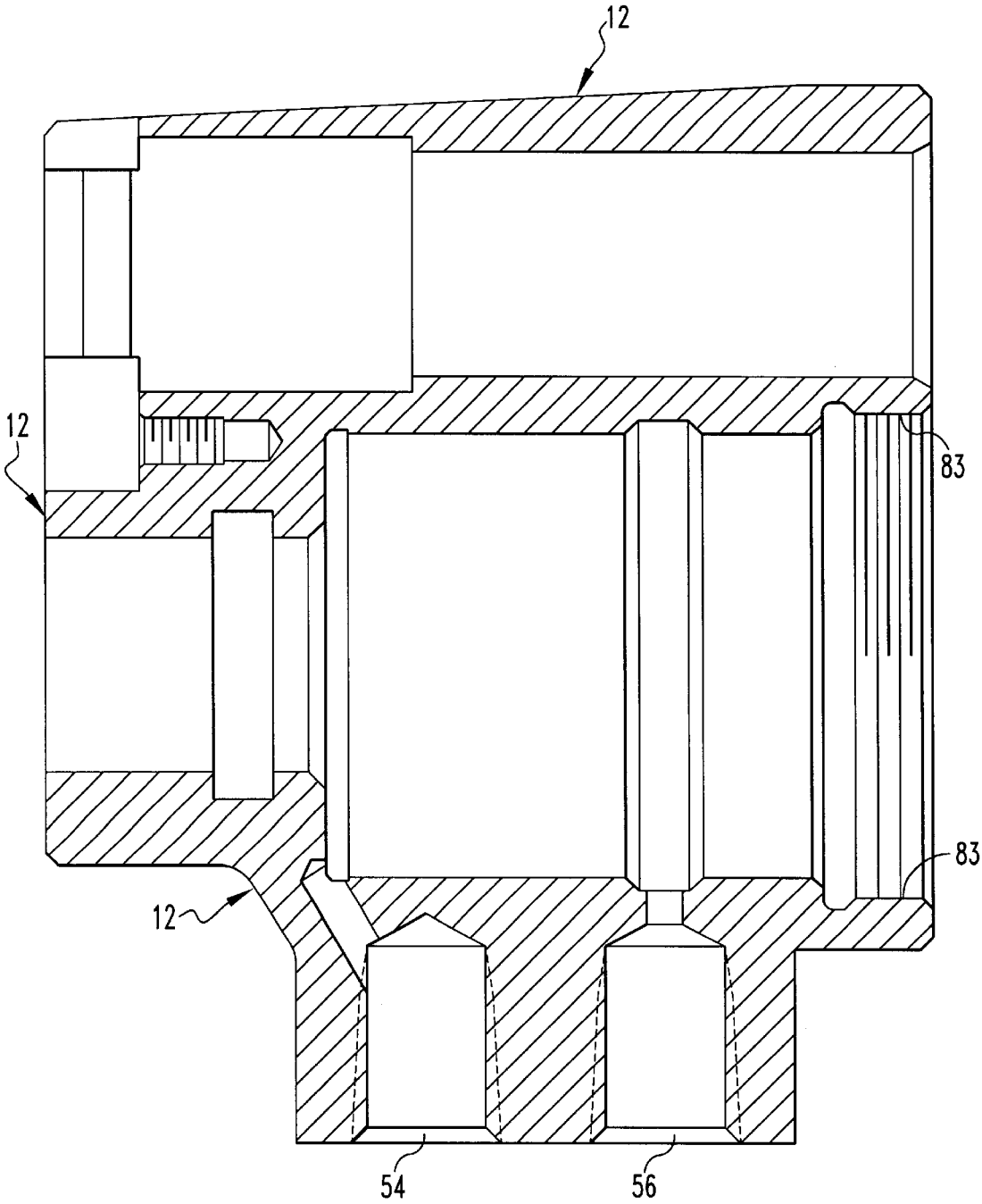
FIG. 2 is a side sectional view, to enlarged scale, of the housing of the installation tool.
Figure 3:
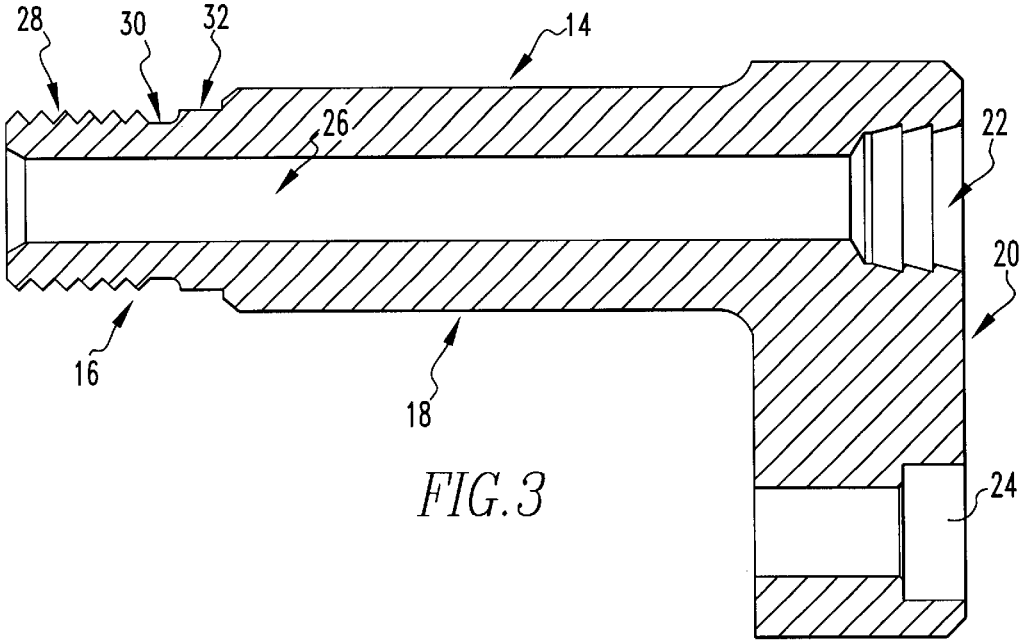
FIG. 3 is a side sectional view, to enlarged scale, of the generally L-shaped drawbar of the installation tool.

In FIG. 1, an installation tool 10 is displayed that includes a housing 12 that has been machined to receive the components of the installation tool 10. FIG. 2 shows a cross sectional view of the housing 12. FIG. 3 displays a generally L-shaped drawbar 14 that has a nose assembly engaging portion 16, a housing portion 18 that is adapted to be slidably disposed in the housing 12, a generally perpendicular extending portion 20 relative to the nose assembly engaging portion 16 and housing portion 18 that includes a recess 22 at the rearward end of the drawbar 14 and a stepped bore 24. A bore 26 extends through the nose assembly engaging portion 16, housing portion 18, the perpendicular extending portion 20 and the recess 22. The nose assembly engaging portion 16 is of a cylindrical construction that has threads 28 disposed on the exterior surface of the drawbar 14 at its forward end. A ring of reduced diameter 30 relative to the nose assembly engaging portion 16 is located adjacent to the threads 28 and a smooth portion 32 is located adjacent to the ring of reduced diameter 30. A portion of greater diameter than the nose assembly engaging portion 16 that consists of the housing portion 18 is located adjacent to the smooth portion 32. Extending generally perpendicularly from the housing portion 18 is the perpendicular extending portion 20. The main features of the perpendicular portion have been previously described.

Figure 4:
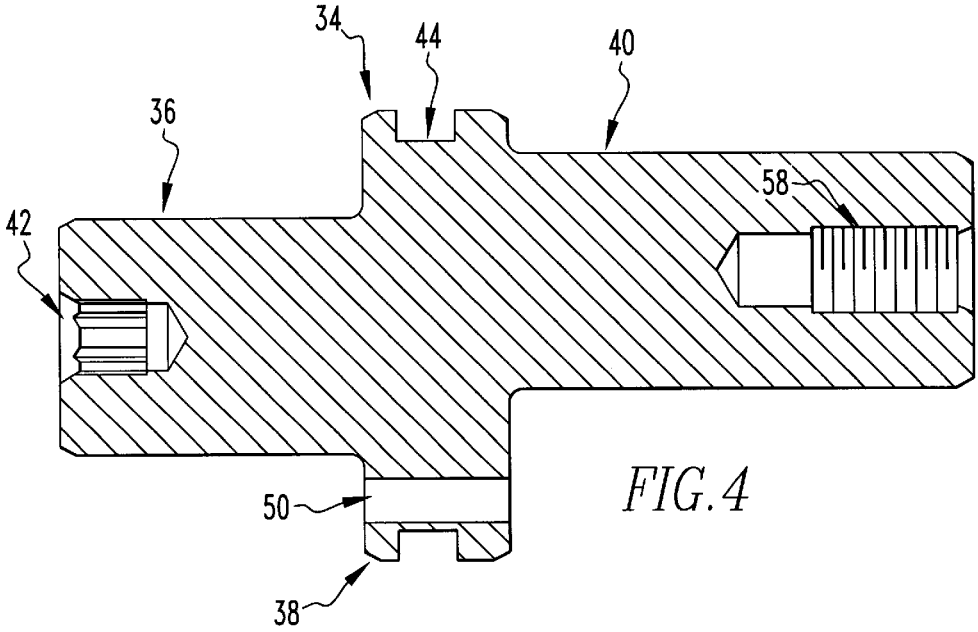
FIG. 4 is a side sectional view, to enlarged scale, of the eccentric piston of the installation tool.

FIG. 4 shows an eccentric piston 34 adapted to have a portion of the piston 34 slidably disposed within the housing 12 of the installation tool 10. The piston 34 has a forward portion 36, a middle portion 38 and a rear portion 40. A recessed bore 42 that is adapted to receive a hex key is provided within the forward portion 36. The forward portion 36 is generally of a smooth cylindrical construction. Adjacent the forward portion 36 is a middle portion 38 of increased diameter than the forward portion 36. A recessed groove 44 is disposed within the middle portion 38 that is adapted to receive an O-ring 46. A back-up ring 48 is located adjacent to the O-ring 46 in the recessed groove 44. A smooth cylindrical bore 50 extends through the middle portion 38 that is adapted to receive a valve 52. The valve 52 consists of a pin that has a smooth cylindrical portion that is disposed within the bore 50 and a square portion that acts as a conduit between an in-bound hydraulic fluid port 54 and an out-bound hydraulic fluid port 56 that are in fluid communication with each other. The rear portion 40 of the piston 34 is generally of a smooth cylindrical construction. A threaded bore 58 that is adapted to receive a screw 60 is located within the rear portion 40. In the forward portion of the housing 12 that slidably supports the piston 34, an O-ring 62 and a backup ring 64 are disposed within a recess in the housing 12 to facilitate maintaining the hydraulic pressure during use of the installation tool 10.

Figure 5:
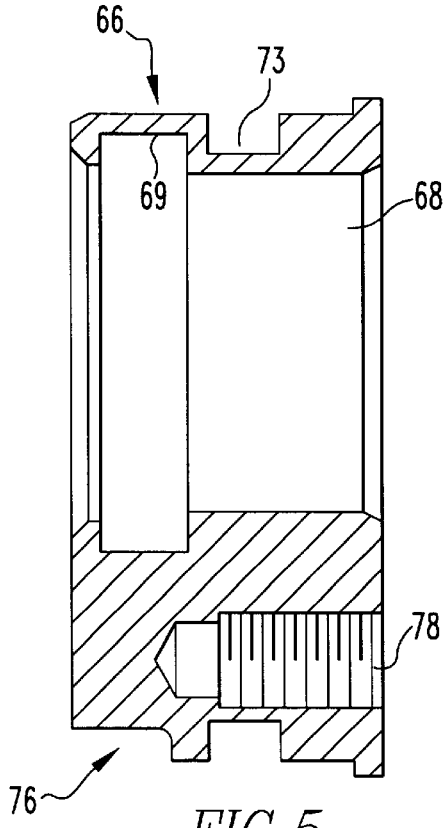
FIG. 5 is a side sectional view, to enlarged scale, of the gland of the installation tool.

FIG. 5 displays a gland 66 that has a bore 68. The bore 68 has a recessed portion 69 that contains an O-ring 70 and a backup ring 72 that facilitate maintaining the hydraulic pressure during use of the installation tool 10. The gland 66 has a recessed portion 73 in the periphery of the gland 66. The recessed portion 73 is adapted to receive an O-ring 74 that facilitates maintaining the hydraulic pressure during use of the installation tool 10. The periphery of the gland 66 also has a smooth rectangular recess 76 that facilitates the removal of hydraulic fluid from the installation tool 10. The gland 66 keeps the hydraulic fluid contained within the installation tool 10. The rearward end of the gland 66 has a threaded bore 78 that is adapted to receive a screw 80. The bore 68 of the gland 66 is adapted to slidably support a portion of the piston 34.

Figure 6:
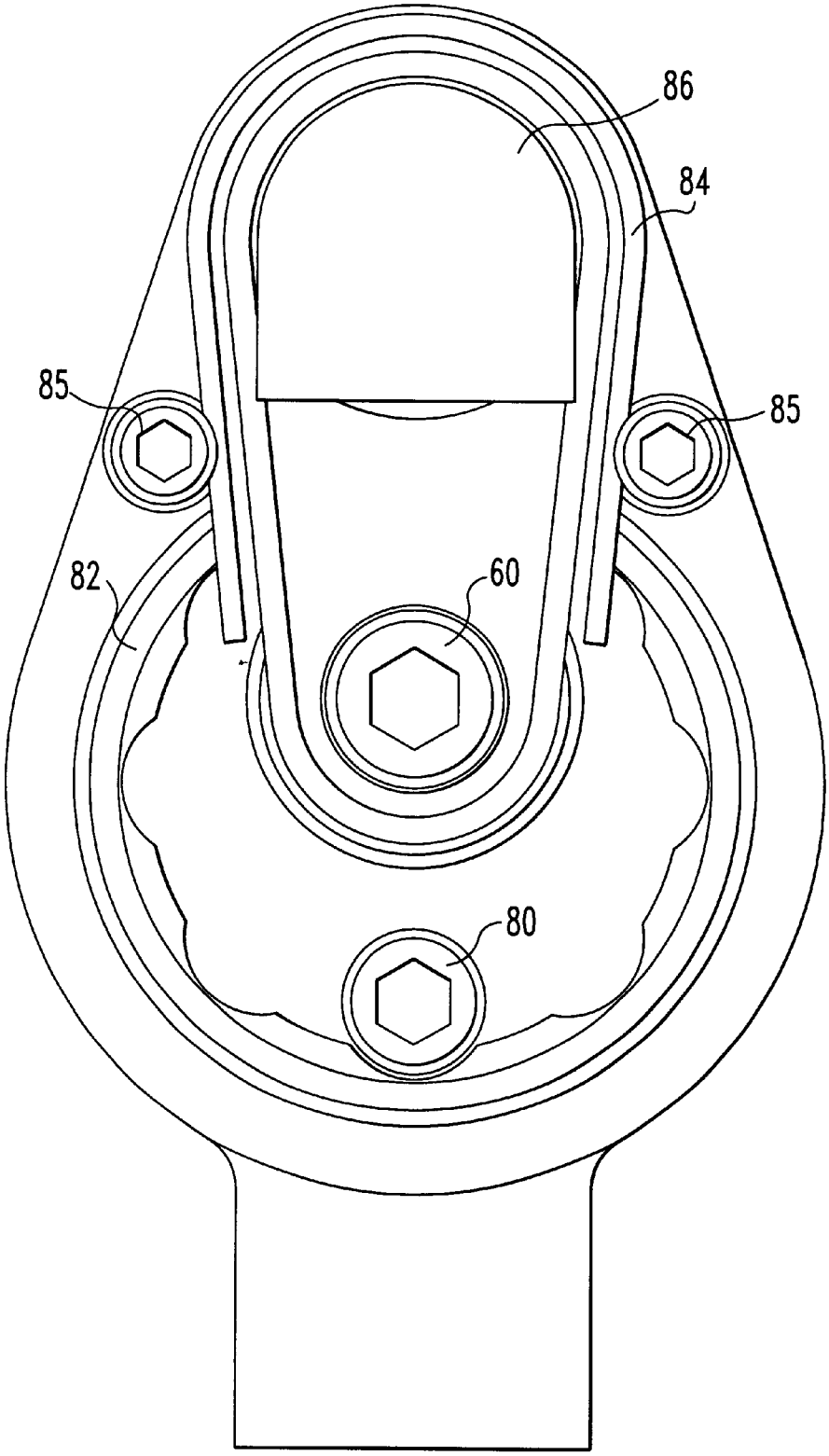
FIG. 6 is an end view, to enlarged scale, of the installation tool of FIG. 1 taken generally in the direction of the Arrow A in FIG. 1.

FIG. 6 shows a retaining ring 82 that has threads disposed on the periphery of the retaining ring 82 that is adapted to be threadedly engaged with threads 83 disposed within the rearward end of the housing 12 that is adapted to contain piston 34. A portion of the piston 34 passes through the retaining ring 82.

One method of assembling the components of the installation tool 10 is as follows. The O-rings 46, 62, 70 and 74 and back-up rings 48, 64 and 72 are disposed within the components of the installation tool 10 as mentioned above. The smooth cylindrical portion of the valve 52 is disposed within the smooth cylindrical bore 50 of the middle portion 38. The piston 34 is disposed within the portion of the housing 12 that is adapted to slidably support the piston 34. The gland 66 is inserted within the rearward portion of the housing 12 that is adapted to slidably support the piston 34 such that a portion of rear portion 40 of the piston 34 passes through the bore 68 of the gland 66 and the smooth rectangular recess 76 is located adjacent to the out-bound hydraulic fluid port 56. The retaining ring 82 is threadedly engaged with the threads 83 disposed within the rearward portion of the housing 12 that is adapted receive the piston 34. A screw 80 is threadedly engaged with the threaded bore 78 of the gland 66 such that the head of screw 80 engages the retaining ring 82. The configuration of the screw 80 and the retaining ring 82 avoid having the retaining ring 82 torque off the installation tool 10 during use. The nose assembly portion 16 and housing portion 18 of the generally L-shaped drawbar 14 are disposed within the housing 12 adapted to receive this portion of the drawbar 14. A screw 60 is provided that passes through the stepped bore 24 and threadedly engages the threaded bore 58 of the piston 34. The screw 60 is torqued to 17–20 ft. lbs which reduces deflection at the juncture of the drawbar 14 and piston 34 after the breackneck groove of a fastener is fractured with the installation tool 10.

A guard assembly 84 is attached to the rearward portion of the housing 12 with two threaded screws 85 that are threadedly engaged with threaded recesses located in the rearward portion of the housing 12. The guard assembly 84 is of sufficient length and strength to avoid having an operator expose their fingers to the reciprocating drawbar 14 and screw 60 during use of the installation tool 10.

Additionally, a pintail deflector 86 that has a projection 87 is engaged with the recess 22 in the drawbar 14. The deflector 86 is constructed of an elastomeric material that can be resiliently, radially expanded for assembly and disassembly relative to the recess 22. The deflector 86 is curved at the rearward end of the deflector such that severed pintails will engage the rearward end as they are ejected, and avoid contact with the operator of the installation tool 10.

Figure 7:
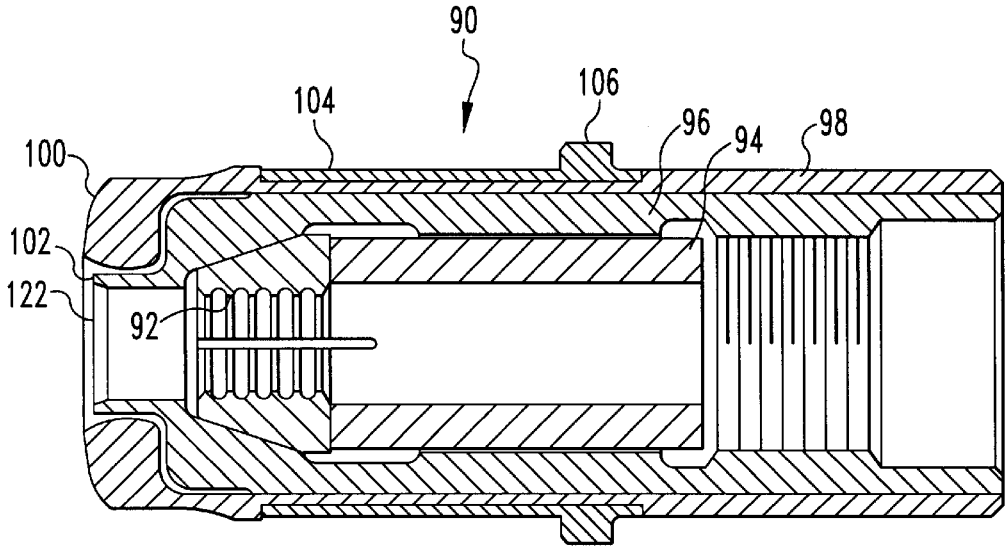
FIG. 7 is a side sectional view, to enlarged scale, of a nose assembly that may be engaged with the drawbar of the installation tool.

FIG. 7 displays a nose assembly 90 can be generally constructed in a manner known to those skilled in the art and therefore is only briefly described for purposes of simplicity. The nose assembly 90 has a plurality of chuck jaws 92 adapted to grip a pin by the pull grooves of the pin. The chuck jaws 92 are located at the forward end of a unitized chuck jaw assembly 94 which is slidably disposed within a tubular collet assembly 96 which is slidably supported in an anvil housing 98 which terminates at one end in a swage anvil member 100. The tubular collet assembly 96 has a tubular collet ejector portion 102 at its forward end and female threads at its rearward end. Optionally, the length of the tubular collet assembly 96 can be extended by using a tubular collet extension (not shown). Such an extension would have male threads at its forward end for threadedly engaging the threads of the tubular collet assembly 96 and have female threads at its rearward end. The female threads on either the tubular collet assembly 96 or tubular collet extension are provided in order to be threadedly engaged with male threads 28 of the drawbar 14. In the embodiment displayed in FIG. 7, a retaining ring 104 is disposed within a circular groove that has been machined into the anvil housing 98. The retaining ring 104 has a pair of opposed flats 106 that are adapted to be disposed within the installation tool 10. The nose assembly 90 is affixed to the installation tool 10 in a manner well known in the art. After the nose assembly 90 is affixed to the installation tool 10, the nose assembly 90 is secured to the installation tool 10 by threadedly engaging a key assembly 107 with a threaded bore disposed in the forward end of the housing 12.

While the installation tool 10, as shown and described, is specifically configured for the installation of lockbolt or swage type fasteners, features of the present invention can be utilized for tools for installing blind fasteners and other non-swage type fasteners which are installed by the application of a relative axial pulling force. Details of such fasteners have been omitted for purposes of simplicity it being understood that references to pins, collars and portions thereof are of the type well known in the fastener art.

A separate hydraulic pressure source 108 is connected to the hydraulic fluid ports 54 and 56 of the installation tool 10 by hydraulic hoses 110 and 112. A control unit 114 that includes a switch (not shown) is also provided that is connected to the hydraulic pressure source 108 via the hydraulic hoses 110 and 112 that is operable from a supply of electric current through suitable conductors to actuate the supply and removal of hydraulic fluid to the installation tool 10. In an alternate embodiment, the control unit 114 may be operable from a source of pneumatic energy to actuate the supply and removal of hydraulic fluid to the installation tool 10. When the switch is depressed, hydraulic fluid is supplied to the installation tool 10. When the switch is released, hydraulic fluid is removed from the installation tool 10. When the switch is depressed, hydraulic pressure is supplied to the installation tool 10 that applies a relative axial force through the nose assembly 90 for setting multi-pieced fasteners such as the lockbolt fasteners and swage type fasteners previously mentioned. When the switch is released, hydraulic pressure is removed from the installation tool 10 and the nose assembly 90 releases its grip on the fastener. The hydraulic pressure source 108, the hydraulic hoses 110 and 112 and the control unit 114 are of constructions known in the art. The details of these components have been omitted for purposes of simplicity.

Hydraulic pressure from the hydraulic pressure source 108 is provided through hydraulic fluid that is in fluid communication with the piston 34 through hydraulic hose 110 and hydraulic port 54. Hydraulic pressure in the installation tool 10 is removed through hydraulic fluid that is in fluid communication with the hydraulic pressure source 108 through valve 52, smooth rectangular recess 76, hydraulic port 56 and hydraulic hose 112.

The hydraulic pressure source 108 has a high pressure section for moving the piston 34 along with the drawbar 14 rearwardly in its setting stroke to set the fastener and an intermediate pressure section for returning the piston 34 along with the drawbar 14 forwardly to its original position after the fastener has been installed and a low pressure tank or return section which receives the hydraulic fluid displaced from the portion of the housing 12 that contains the piston 34 during the high pressure setting stroke or the intermediate pressure return stroke.

The installation tool 10 will be normally in a deactuated condition. With the switch in a deactuated condition, i.e. when not depressed by the operator, the control unit 114 will condition the hydraulic pressure source 108 to connect port 118 to the return or tank section and the port 120 to the intermediate pressure section which is at a hydraulic pressure higher than that at the return or tank section. In this condition, the rearward end of the housing 12 that contains the piston 34 will be pressurized relative to the forward end of the housing 12 that contains the piston 34 portion of the housing 12 urging the piston 34 to its returned or deactuated position as shown in FIG. 1.

To actuate the installation tool 10, the operator simply depresses the actuating switch which signals the control unit 114 to condition the hydraulic pressure source 108 to connect the port 118, and the hydraulic line 110, to the high pressure section and to connect the port 120 and hydraulic line 112 to the return or tank section. In this condition, the forward end of the housing 12 that contains the piston 34 will be connected to the high hydraulic pressure section while the rearward end of the housing 12 that contains the piston 34 will be connected to return or tank section.

In the deactuated condition of installation tool 10, the chuck jaws 92 are radially separated and in an opened condition. In this condition, the shank of a pin of a swage type fastener can be inserted through the aperture or swage cavity 122 and into the opening defined by the radially separated chuck jaws 92. Upon actuation of the piston 34 along with the drawbar 14 rearwardly in its pull stroke, the tubular collet assembly 96 is moved rearwardly. As this occurs, the chuck jaws 92 are moved radially inwardly as well. Chuck jaws 92 are moved to their radially closed position in which the chuck jaw teeth now fully grip the similarly shaped grooves on the pull portion of the pin shank of the fastener. With the jaw teeth of chuck jaws 92 gripping the pull grooves of the pin, the adjacent side surfaces of the chuck jaws 92 will be slightly spaced from each other. In this position the chuck jaws 92 will define a generally circular aperture of around 360 degrees. At this time, the swage cavity 122 is engaged with the fastener collar which is located over the shank of the pin. Further movement of the tubular collet assembly 96 and the jaw assembly 94 relative to the swage cavity 122 will result in application of the desired relative axial force whereby the collar will be swaged onto lock grooves on the shank of the pin. Upon the application of additional relative axial force, the pin member will be severed at the breakneck groove. Upon fracture of the pin shank, the resultant shock load will move the jaw assembly 94 axially rearwardly and, at the same time, will resiliently move the chuck jaws 92 to their open condition whereby the severed portion of the pin shank will be released by the chuck jaws 92. The severed portion of the pin member will then pass through the installation tool 10 via the bore 26 for ejection out at the rearward end.

Next, the installation tool 10 is returned to its original, deactuated condition by the operator releasing the actuating switch. In this condition, the control unit 114 conditions the hydraulic pressure source 108 to connect the forward end of the housing that contains the piston 34 to the tank or return section and the rearward end of the housing 12 that contains the piston 34 to the intermediate pressure section. Now, the piston 34 along with the drawbar 14 on its return stroke is moved axially forwardly to its original, axially forward position. As this occurs, the collar ejector member 102 engaged the swaged collar whereby the swaged collar is ejected from the swage cavity 122.

After pin break and with the piston 34 in its fully actuated rearward position at the end of the pull stroke, the high pressure being applied during the pull stroke could increase since the piston 34 is no longer moving. The potentially high pressure that could be built up in the forward end of the housing 12 that contains the piston 34 is relieved by way of the clearance between the flats of the valve 52 and the smooth rectangular recess 76. In this position, the valve 52 permits high pressure fluid to flow from the forward end of the housing 12 that contains the piston 34 to the rearward end of the housing 12 that contains the piston 34 and thereafter to the tank or return section of the hydraulic pressure source 108. This reduces the pressure at the forward end of the housing 12 that contains the piston 34 to thereby inhibit damage to the installation tool 10.

In the preferred embodiment of the invention, the installation tool has a one half inch center line to edge distance that permits the installation tool 10 to be used in applications that provide a limited amount of space to the operator of the installation tool 10. The one half inch centerline to edge distance is achieved by the piston 34 reciprocating in the housing 12 parallel to the reciprocating movement of the drawbar 14. The installation tool 10 is also of a compact construction which allows the installation tool 10 to be used in areas of limited space. The installation tool 10 has a minimal overall length while maintaining single stroke fastener installation.

In operation, the installation tool is typically operated between 5400 to 5700 pounds per square inch. Operating the installation tool 10 at that pressure allows the hydraulic hoses 54 and 56 to remain flexible to extend the range of movement an operator would have using the installation tool 10.

Having described the presently preferred embodiments of the invention, it is to be understood that the invention may be otherwise embodied within various functional equivalents within the scope of the appended claims.

What is claimed is:

1. A hydraulic installation tool for installing fasteners comprising:

(a) a housing having a first portion adapted to receive a drawbar and a second portion adapted to receive a piston, a gland and a retaining ring;

(b) the drawbar having a general L-shape, a through bore and a bore, a portion of the drawbar being slidably disposed within the first portion of the housing;

(c) the piston having a threaded bore, a portion of the piston being slidably disposed within the second portion of the housing;

(d) the gland having a first bore adapted to receive a portion of the piston and a threaded second bore, the gland disposed within the second portion of the housing with a portion of the piston passing through the first bore of the gland;

(e) the retaining ring having a bore, the retaining ring disposed within the second portion of the housing and threadedly engaging the housing with a portion of the piston passing through the bore of the retaining ring;

(f) a threaded first screw passing through the bore of the drawbar and threadedly engaging the threaded bore of the piston; and (g) a threaded second screw passing through the bore of the retaining ring and threadedly engaging the threaded second bore of the gland.

2. The hydraulic installation tool of claim 1 further comprising a nose assembly engaged with the drawbar.

3. The hydraulic installation tool of claim 1 further comprising a deflector engaged with the drawbar.

4. The hydraulic installation tool of claim 1 further comprising a guard assembly engaged with the housing.

5. The hydraulic installation tool of claim 1 wherein the piston has a middle portion, the middle portion having a bore disposed in the middle portion, the hydraulic installation tool further comprising a valve that is disposed within the bore of the middle portion that is adapted to release hydraulic pressure in the tool.

6. A hydraulic installation tool for installing fasteners comprising:

(a) a housing having a first portion adapted to receive a drawbar and a second portion adapted to receive a piston, a gland and a retaining ring;

(b) the drawbar having a general L-shape, a through bore and a bore, a portion of the drawbar being slidably disposed within the first portion of the housing;

(c) the piston having a threaded bore, a portion of the piston being slidably disposed within the second portion of the housing;

(d) the gland having a first bore adapted to receive a portion of the piston and a threaded second bore, the gland disposed within the second portion of the housing with a portion of the piston passing through the first bore of the gland;

(e) the retaining ring having a bore, the retaining ring disposed within the second portion of the housing and threadedly engaging the housing with a portion of the piston passing through the bore of the retaining ring;

(f) a threaded first screw passing through the bore of the drawbar and threadedly engaging the threaded bore of the piston; and (g) a threaded second screw passing through the bore of the retaining ring and threadedly engaging the threaded second bore of the gland wherein the portion of the drawbar slidably disposed within the first portion of the housing is adapted to reciprocate in a plane that is generally parallel to another plane of reciprocation of the portion of the piston slidably disposed within the second portion of the housing.

7. The hydraulic installation tool of claim 6 further comprising a nose assembly engaged with the drawbar.

8. The hydraulic installation tool of claim 6 further comprising a deflector engaged with the drawbar.

9. The hydraulic installation tool of claim 6 further comprising a guard assembly engaged with the housing.

10. The hydraulic installation tool of claim 6 wherein the piston has a middle portion, the middle portion having a bore disposed in the middle portion, the hydraulic installation tool further comprising a valve that is disposed within the bore of the middle portion that is adapted to release hydraulic pressure in the tool.

11. A hydraulic installation tool for installing fasteners comprising:

(a) a housing having a first portion adapted to receive a drawbar and a second portion adapted to receive a piston, a gland and a retaining ring;

(b) the drawbar having a general L-shape, a through bore and a bore, a portion of the drawbar being slidably disposed within the first portion of the housing;

(c) the piston having a threaded bore, a portion of the piston being slidably disposed within the second portion of the housing;

(d) the gland having a first bore adapted to receive a portion of the piston and a threaded second bore, the gland disposed within the second portion of the housing with a portion of the piston passing through the first bore of the gland;

(e) the retaining ring having a bore, the retaining ring disposed within the second portion of the housing and threadedly engaging the housing with a portion of the piston passing through the bore of the retaining ring;

(f) a threaded first screw passing through the bore of the drawbar and threadedly engaging the threaded bore of the piston;

(g) a threaded second screw passing through the bore of the retaining ring and threadedly engaging the threaded second bore of the gland; and (h) an in-bound and an out-bound hydraulic fluid port disposed within the housing, the ports being adapted to receive hydraulic hoses, the ports communicating with the second portion of the housing that contains a portion of the piston.

12. The hydraulic installation tool of claim 11 further comprising a nose assembly engaged with the drawbar.

13. The hydraulic installation tool of claim 11 further comprising a deflector engaged with the drawbar.

14. The hydraulic installation tool of claim 11 further comprising a guard assembly engaged with the housing.

15. The hydraulic installation tool of claim 11 wherein the piston has a middle portion, the middle portion having a bore disposed in the middle portion, the hydraulic installation tool further comprising a valve that is disposed within the bore of the middle portion that is adapted to release hydraulic pressure in the tool.

16. The hydraulic installation tool of claim 11 further comprising a hydraulic pressure source and hydraulic hoses having a first end and a second end, the first end of the hydraulic hoses connected to the hydraulic fluid ports and the second end of the hydraulic hoses connected to the hydraulic pressure source.

17. The hydraulic installation tool of claim 16 further comprising a control unit connected to the hydraulic hoses, the control unit being adapted to selectively supply or remove hydraulic pressure to the installation tool.

18. The hydraulic installation tool of claim 17 wherein the control unit has a switch.

19. The hydraulic installation tool of claim 18 wherein the switch is actuable from a supply of electric current through suitable conductors to actuate the supply and removal of hydraulic fluid to the installation tool.

20. The hydraulic installation tool of claim 18 wherein the switch is actuable from a source of pneumatic energy through suitable connectors to actuate the supply and removal of hydraulic fluid to the installation tool.

* * * * *